US008585200B2

(12) United States Patent
Veis

(10) Patent No.: US 8,585,200 B2
(45) Date of Patent: Nov. 19, 2013

(54) IMAGE FORMING SYSTEM, MEDIA DRYING DEVICE USABLE THEREWITH AND METHOD THEREOF

(75) Inventor: Alex Veis, Kadima (IL)

(73) Assignee: Hewlett-Packard Industrial Printing Ltd., Netanya (IL)

( * ) Notice: Subject to any disclaimer, the term of this patent is extended or adjusted under 35 U.S.C. 154(b) by 72 days.

(21) Appl. No.: 13/158,769

(22) Filed: Jun. 13, 2011

(65) Prior Publication Data

US 2012/0313996 A1 Dec. 13, 2012

(51) Int. Cl.
*B41J 2/01* (2006.01)

(52) U.S. Cl.
USPC ..... 347/102

(58) Field of Classification Search
CPC ..... B41J 11/0015; B41J 11/0085; B41J 11/06
USPC ..... 347/16, 20, 101, 102, 104
See application file for complete search history.

(56) References Cited

U.S. PATENT DOCUMENTS

| | | | | |
|---|---|---|---|---|
| 7,771,039 | B2 * | 8/2010 | Sakagami | 347/102 |
| 7,883,204 | B2 * | 2/2011 | Shinkawa et al. | 347/104 |
| 8,182,080 | B2 * | 5/2012 | Kawakami et al. | 347/102 |
| 8,272,730 | B2 * | 9/2012 | Hori | 347/102 |
| 2012/0069110 | A1 * | 3/2012 | Nakazawa et al. | 347/102 |

* cited by examiner

*Primary Examiner* — An Do
(74) *Attorney, Agent, or Firm* — Victor DeVito

(57) ABSTRACT

An image forming system, a media drying device usable therewith and a method are disclosed. The image forming system, media drying device and method include application of heat in a form of heated air to liquid ink disposed on media to remove water from the liquid ink in a form of vapor. The image forming system, media drying device and method also include recovery of at least a portion of the heat from the media.

14 Claims, 6 Drawing Sheets

IMAGE FORMING SYSTEM, MEDIA DRYING DEVICE USABLE THEREWITH AND METHOD THEREOF

BACKGROUND

Image forming systems include ink applicator units to form images on media. The ink applicator units such as inkjet printheads may eject liquid ink onto the media. Drying devices may be used to dry the liquid ink deposited on the media to increase image quality of the images formed therewith.

BRIEF DESCRIPTION OF THE DRAWINGS

Non-limiting examples of the present disclosure are described in the following description, read with reference to the figures attached hereto and do not limit the scope of the claims. In the figures, identical and similar structures, elements or parts thereof that appear in more than one figure are generally labeled with the same or similar references in the figures in which they appear. Dimensions of components and features illustrated in the figures are chosen primarily for convenience and clarity of presentation and are not necessarily to scale. Referring to the attached figures:

DETAILED DESCRIPTION

Figure 1:
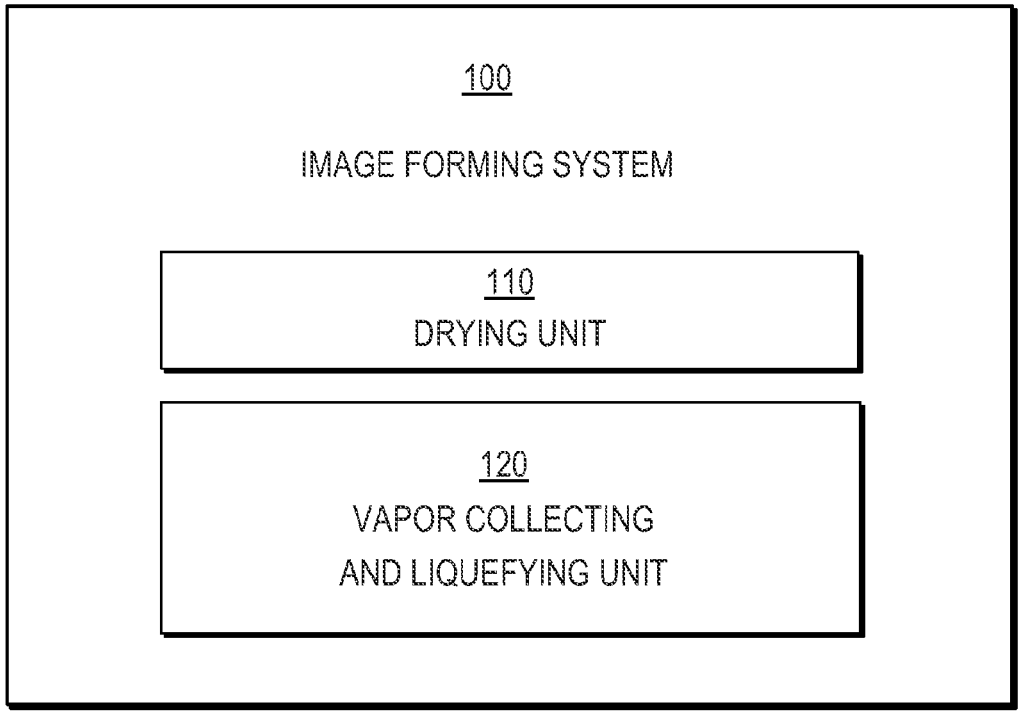
FIG. 1 is a block diagram illustrating an image forming system according to an example.

In the following detailed description, reference is made to the accompanying drawings which form a part hereof, and in which is depicted by way of illustration specific examples in which the present disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims.

Image forming systems such as high speed web presses may include ink applicator units to form images on media. The ink applicator units such as inkjet printheads may eject liquid ink onto the media. A drying device may be used to dry the liquid ink water-based ink deposited on the media to increase image quality and throughput of the image forming system. The drying device, however, may consume a great amount of energy to dry the liquid ink deposited on media. For example, a great amount of energy to dry the liquid ink is consumed with respect to image forming systems such as high speed web presses that continuously print onto large quantities of media. Further, the disposal of the water removed from the liquid ink in the liquid ink drying operations may also be costly. Consequently, the cost to operate the image forming system may increase due to the great amount of energy necessary to dry the liquid ink and the disposal of the water resulting from the ink drying operations.

In some examples, an image forming system includes, among other things, a drying unit and a vapor collecting and liquefying unit. The drying unit may apply heat in a form of heated air to liquid ink disposed on media to remove water from the liquid ink in a form of vapor. The drying unit may also recover at least a portion of the heat from the vapor and the media. Such heat recovery may be used for subsequent drying operations. Thus, a reduction in an amount of newly generated heat needed to dry the liquid ink on subsequent media may be achieved. That is, the drying of liquid ink on subsequent media uses heat recovered from previously-dried media and liquid ink thereon. The vapor collecting and liquefying unit may collect the vapor and restore the water from the vapor. Such restored water may be reused to generate restored liquid ink. That is, the restored water may be mixed with ink concentrate to form restored liquid ink. Thus, the disposal of the water resulting from the liquid ink drying operations is reduced and/or eliminated. Further, the generation of restored liquid ink may be provided on demand. Accordingly, the recovery of at least a portion of the heat from the vapor and media as well as the restoring of water may decrease the cost of operating the image forming system and increase the throughput of the image forming system.

In some examples, a media drying device usable with an image forming system includes, among other things, a drying unit. The drying unit may include a drying chamber to receive media therein. The drying unit may apply heat in a form of heated air to liquid ink disposed on the media in the drying chamber to remove water from the liquid ink in a form of vapor. The drying unit may also recover at least a portion of the heat from the vapor and the media. Such heat recovery may be used for subsequent liquid ink drying operations. Thus, a reduction in an amount of newly generated heat needed to dry the liquid ink on subsequent media may be achieved. Thus, the recovery of at least a portion of the heat from the vapor and the media may decrease the cost of operating the image forming system and increase the throughput thereof.

FIG. 1 is a block diagram illustrating an image forming system according to an example. Referring to FIG. 1, in some examples, an image forming system 100 includes a drying unit 110 and a vapor collecting and liquefying unit 120. The drying unit 110 may apply heat in a form of heated air to liquid ink such as water-based ink disposed on media to remove water from the liquid ink in a form of vapor. In some examples, the water may include particles, and the like. The drying unit 110 may also recover at least a portion of the heat from the vapor and the media. In some examples, latent heat may be recovered from the vapor and heat energy from the heated media. The vapor collecting and liquefying unit 120 may collect the vapor and restore the water from the vapor. That is, the vapor collecting and liquefying unit 120 may transform the vapor into the water. In some examples, the vapor collecting and liquefying unit 120 may include a container to receive the vapor and store the resulting water converted therefrom. In some examples, the restored water may also be filtered by a filter unit (not illustrated).

Figure 2:
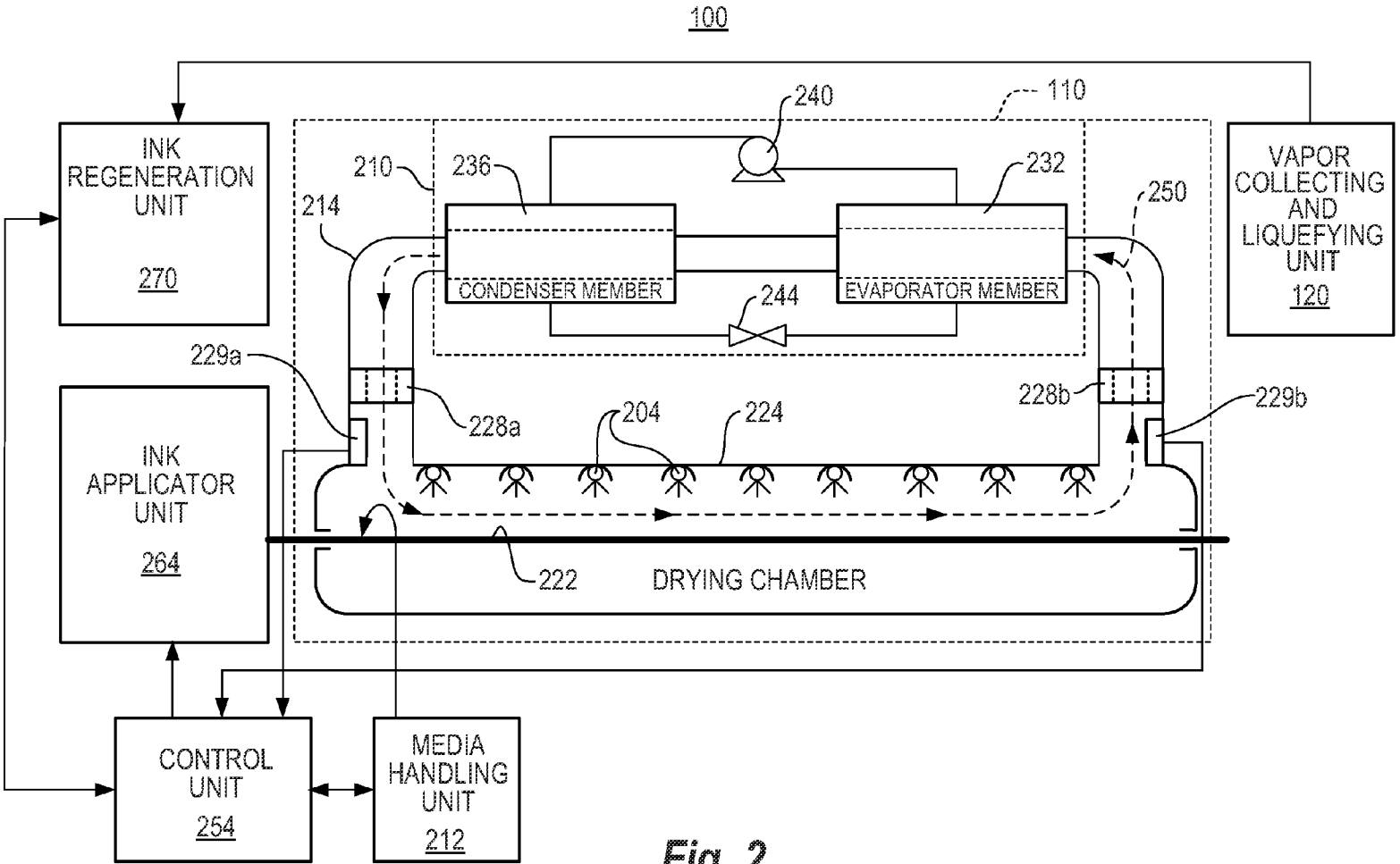
FIG. 2 is a schematic view illustrating the image forming system of FIG. 1 according to an example.

FIG. 2 is a schematic view illustrating the image forming system of FIG. 1 according to an example. Referring to FIG. 2, in some examples, the dryer unit 110 may include a closed cycle mechanical heat pump dryer. For example, the dryer unit 110 may include a heat pump unit 210, an air circulation unit 214, and infrared drying members 204. The heat pump unit 210 may heat air and direct the heated air to the media 222 and the liquid ink disposed on the media 222. For example, the heat pump unit 210 may also include a refrigerant (not illustrated), an evaporator member 232, a condenser member 236, an expansion valve 244 and a compressor member 240.

The refrigerant may include carbon dioxide, and the like. The evaporator member 232 may transform the refrigerant from a liquid state to a gas state to enable the refrigerant to absorb the heat to form exhausted air. The condenser member 236 may condense the refrigerant from the gas state to the liquid state to enable the refrigerant to release the heat to form the heated air. The expansion valve 244 may lower pressure of the refrigerant received from the condenser member 236 and provide the refrigerant to the evaporator member 232. The compressor member 240 may increase a pressure of and circulate the refrigerant between the evaporator member 232, the condenser member 236, and the expansion valve 244.

Referring to FIG. 2, in some examples, the infrared drying members 204 may provide infrared energy to the liquid ink on the media 222 to increase an evaporation rate of the water. For example, the infrared drying members 204 may be used to bootstrap a steady state of a temperature in the drying chamber 224 by decreasing an amount of time in which the temperature in the drying chamber 224 reaches thermal equilibrium. The air circulation unit 214 may also include a drying chamber 224, a plurality of fans 228*a* and 228*b*, an air circulation path 250, an inlet temperature sensor 229*a* and an outlet temperature sensor 229*b*. The drying chamber 224 may selectively receive the media 222 with the liquid ink disposed thereon and receive the heated air from the heat pump unit 210. The plurality of fans 228*a* and 228*b* may direct the heated air into and out of the drying chamber 224. In some examples, the air circulation path 250 may also include additional sensors such as humidity and air flow sensors (not illustrated).

Figure 5:
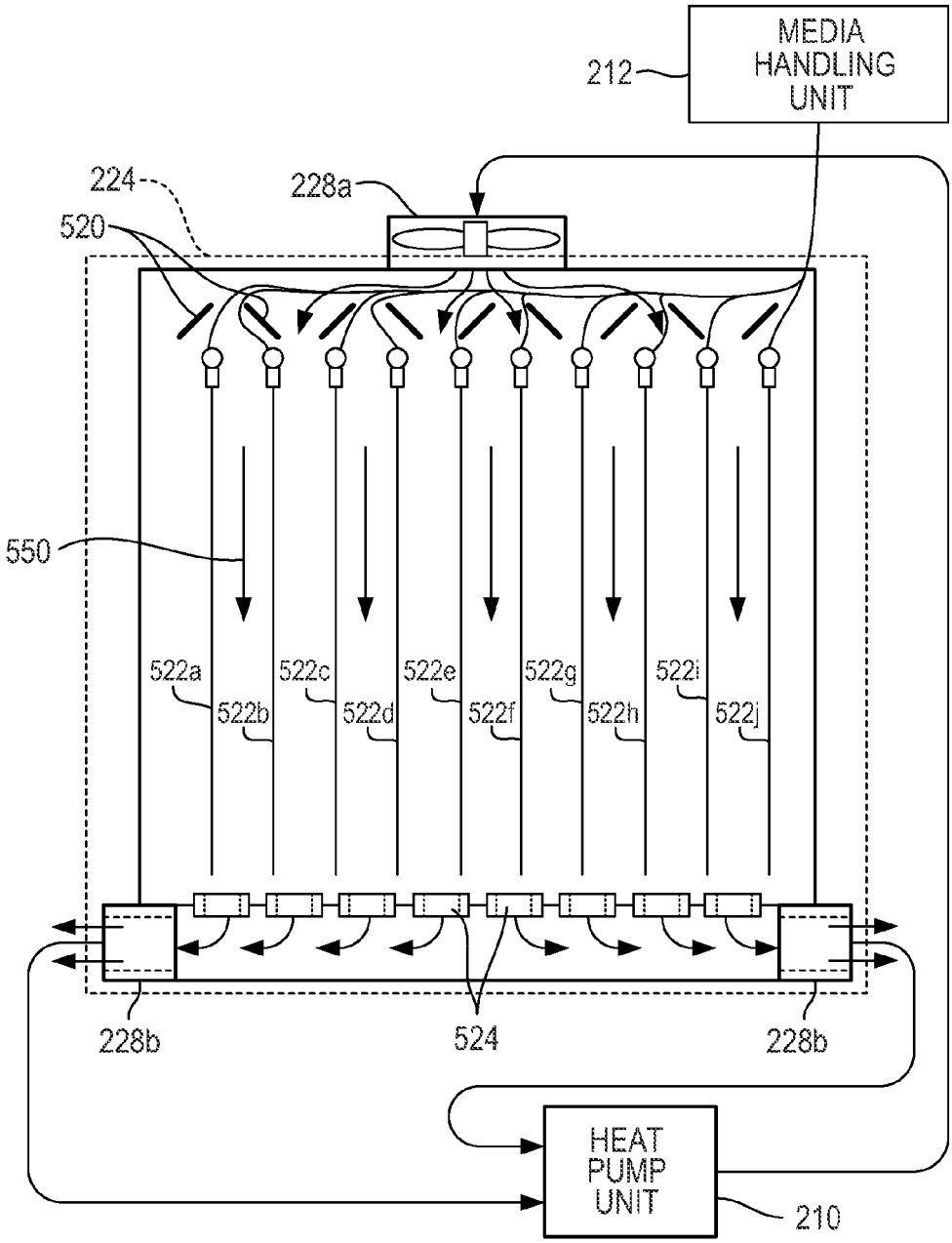
FIG. 5 is a schematic view illustrating a drying chamber of the media drying device of FIG. 4 according to an example.

As illustrated in FIG. 2, the air circulation path 250 may transport the heated air, for example, formed by the condenser member 236 of the heat pump unit 210, through the drying chamber 224 and to the evaporator member 232 of the heat pump unit 210. The inlet temperature sensor 229*a* may measure a first temperature of the heated air entering the drying chamber 224. The outlet temperature sensor 229*b* may measure a second temperature of the heated air leaving the drying chamber 224. The first and second temperature may be provided to a control unit 254. In some examples, the drying chamber 224 may also include a plurality of airflow directional members 520 and 524 as illustrated in FIG. 5. For example, a first set of airflow directional members 520 may control a direction of the heated air within the drying chamber 224 and a second set of airflow directional members 524 may control a direction of the heated air directed towards an outside of the drying chamber 224. For example, the airflow directional members 520 and 524 may include venting members, louver members, and the like.

Referring to FIG. 2, in some examples, the image forming system 100 may also include an ink applicator unit 264, an ink regeneration unit 270, a media handling unit 212, and a control unit 254. The ink applicator unit 264 may apply the liquid ink to the media 222 disposed in a print zone to form images thereon. For example, the ink applicator unit 264 may be a static printhead extending at least across the width of media upon which to be printed, a plurality of printhead modules mounted on a scanning carriage, and the like. The ink regeneration unit 270 may provide the restored water to an ink concentrate to form restored liquid ink and to supply the restored liquid ink to the ink applicator unit 264. The restored liquid ink may be formed, for example, in an ejectable state for use in the ink applicator unit 264 such as an inkjet printhead. The media handling unit 212 may transport the media 222 to and from the print zone.

Referring to FIG. 2, in some examples, the control unit 254 may control a handling of the media 222 and a supplying of the restored liquid ink to the ink applicator unit 264. The control unit 254 may include a raster image processor. In some examples, the control unit 254 may provide print data to the ink applicator unit 264, media control data to the media handling unit 212, and generate and provide ink consumption data to the ink regeneration unit 270. In some examples, an amount of ink to purge the ink applicator unit 264 may also be provided as, or in addition to, ink consumption data.

Figure 3:
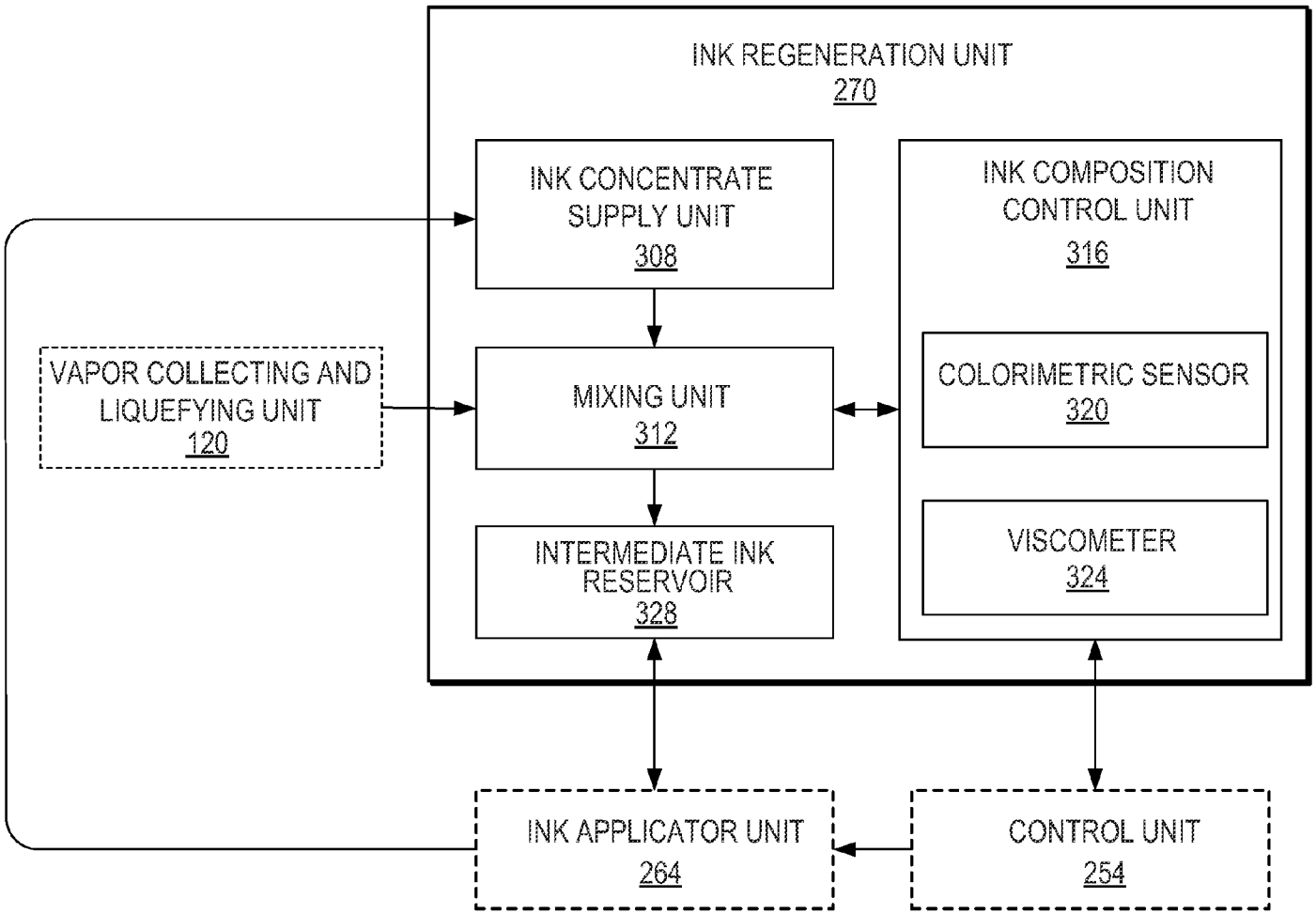
FIG. 3 is a block diagram illustrating an ink regeneration unit of the image forming system of FIG. 2 according to an example.

FIG. 3 is a block diagram illustrating an ink regeneration unit of the image forming system of FIG. 2 according to an example. Referring to FIG. 3, in some examples, the ink regeneration unit 270 may include a mixing unit 312, an ink concentrate supply unit 308, an ink composition control unit 316, and an intermediate ink reservoir 328. The mixing unit 312 may mix the restored water, for example, provided by the vapor collecting and liquefying unit 120, with the ink concentrate to form restored liquid ink. For example, the mixing unit 312 may include an impellor, worm-type steering system, and the like. In some examples, the ink regeneration unit 270 may prepare and supply the restored liquid ink on-demand such as in real-time. In some examples, the ink concentrate supply unit 308 may include a reservoir to store the ink concentrate and a pump to transport the ink concentrate from the reservoir to the mixing unit 312. The ink concentrate supply unit 308 may supply the ink concentrate to the mixing unit 312. In some examples, additives may be added to the ink concentrate such as wetting agents, surface tension regulating agents, antibacterial agents, and the like.

Referring to FIG. 3, in some examples, the ink composition control unit 316 may be in fluid communication with the restored liquid ink, for example, through the mixing unit 312, to control at least one parameter of the restored liquid ink in real-time. The ink composition control unit 316 may also include a colorimetric sensor 320 and a viscometer 324. The colorimetric sensor 320 may measure a color parameter of the restored liquid ink and provide the measured color parameter to the control unit 254 and/or the mixing unit 312.

The viscometer 324 may measure a viscosity parameter of the restored liquid ink and provide the measured viscosity parameter to the control unit 254 and/or the mixing unit 312. For example, the viscometer 324 may include a vibration viscometer, a rotational viscometer, and the like. The intermediate ink reservoir 328 may include a level sensor unit (not illustrated) to determine a level of the restored liquid ink therein. In some examples, the intermediate ink reservoir 328 may store the restored liquid ink to be provided to the ink applicator unit 264. The ink applicator unit 264 may communicate the liquid ink demands with the ink concentrate supply unit 308 and/or the intermediate ink reservoir 328 directly or through the control unit 254.

Figure 4:
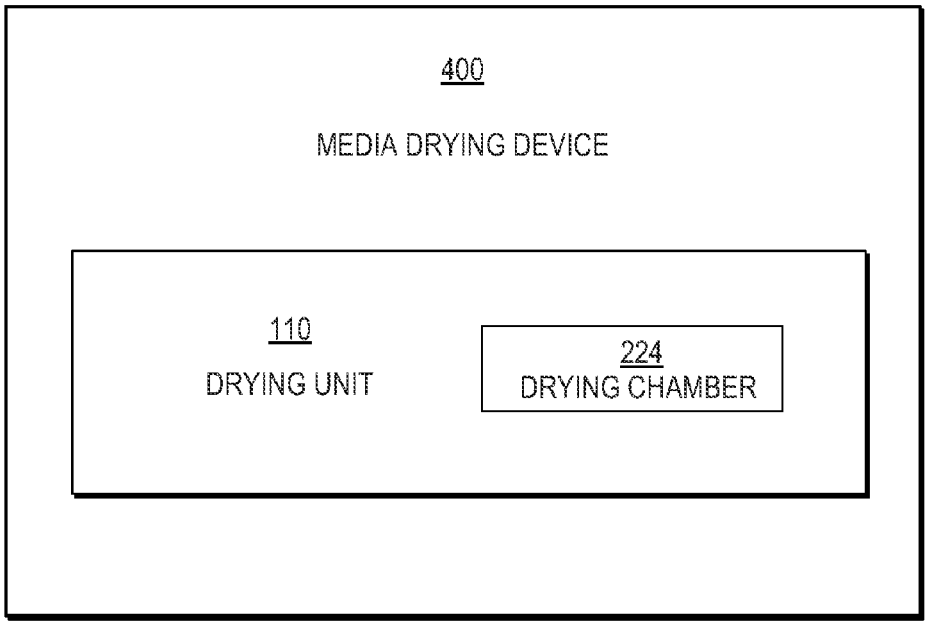
FIG. 4 is a block diagram illustrating a media drying device usable with an image forming system according to an example.

FIG. 4 is a block diagram illustrating a media drying device usable with an image forming system according to an example. FIG. 5 is a schematic view illustrating a drying chamber of the media drying device of FIG. 4 according to an example. Referring to FIGS. 4 and 5, in some examples, a media drying device 400 may include a drying unit 110. The drying unit 110 may include a drying chamber 224. The drying unit 110 may apply heat in a form of heated air to liquid ink disposed on media 522*a*, 522*b*, . . . , 522*j* (collectively 522) to remove water from the liquid ink in a form of vapor. The drying unit 110 may also recover at least a portion of the heat from the vapor and the media 522.

Such heat recovery may be used for subsequent liquid ink drying operations to reduce an amount of newly generated heat needed to dry the liquid ink on subsequent media. The liquid ink drying operations may include placing the media 522 into the drying chamber 224. In some examples, the drying unit 110 may also include a heat pump unit 210, infrared drying members 204, and a plurality of fans 228*a* and 228*b* as previously disclosed with respect to FIG. 2.

Referring to FIGS. 4 and 5, in some examples, a drying chamber 224 may include a plurality of airflow directional members 520 and 524. For example, a first set of airflow directional members 520 may control a direction of the heated air within the drying chamber 224 and a second set of airflow directional members 524 may control a direction of the heated air towards outside of the drying chamber 224. For example, the airflow directional members 520 and 524 may include venting members, louver members, and the like. In some examples, the air input to the drying chamber 224 may be generated from the heat pump unit 210 such as from the condenser member 236 (FIG. 2) thereof. Additionally, the air output from the drying chamber 224 may be provided to the heat pump unit 210 such as to the evaporator member 232 (FIG. 2) thereof. Accordingly, in some examples, air flow 550 in the drying chamber 224 directs heat at the media 522 and recovers heat from the media 522.

Referring to FIG. 5, the drying chamber 224 may selectively receive media 522 having liquid ink disposed thereon to interact with the heated air. Such interaction, for example, allows the media 522 to be heated and the drying of the liquid ink through removal of water by formation of vapors and the media 522 to be heated. Subsequently, exhausted air may also be directed toward the heated media 522 to recovery heat therefrom. Such recovered heat, for example, may be used for subsequent liquid ink drying operations to reduce an amount of newly generated heat needed to dry the liquid ink on subsequent media. In some examples, the vapors may be directed to a vapor collecting and liquefying unit 120, for example, through the evaporator member 232, to collect the vapor and restore the water from the vapor as previously disclosed with respect to FIG. 2. The heated air and the exhausted air may be generated by the heat pump unit 210 as previously disclosed with respect to FIG. 2.

Figure 6:
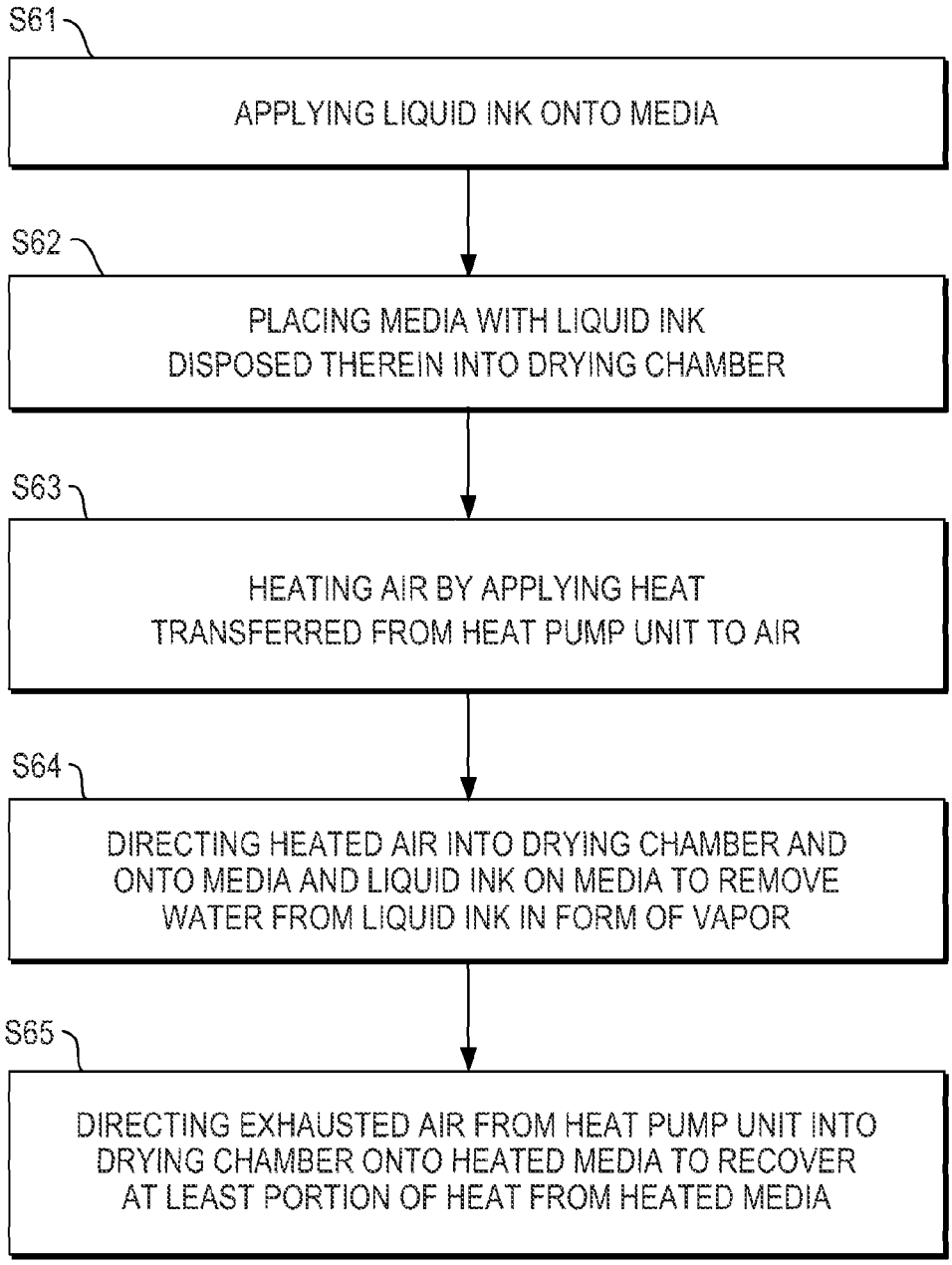
FIG. 6 is a flowchart illustrating a method of drying liquid ink on a media of an image forming system according to an example.

FIG. 6 is a flowchart illustrating a method of drying liquid ink on a media of an image forming system according to an example. Referring to FIG. 6, in block S61, liquid ink is applied onto a media. For example, an ink applicator unit may eject liquid ink on the media to form images corresponding to print data. In block S62, the media with the liquid ink disposed therein is placed into a drying chamber. For example, the media may be placed and oriented in the drying chamber by a media handling unit. In block S63, heat transferred from a heat pump unit is applied to air to heat air. In block S64, the heated air is directed into the drying chamber and onto the media and the liquid ink on the media to remove water from the liquid ink in a form of vapor.

In block S65, exhausted air from the heat pump unit is directed into the drying chamber onto the heated media to recover at least a portion of the heat from the heated media. For example, the recovery of at least a portion of the heat from the heated media may also include at least a portion of the heat being directed to the heat pump unit to transfer the heat to the air. In some examples, the method may also include the water being restored from the vapor, restored liquid ink being generated to be applied to respective media by mixing an ink concentrate and the restored water, and also recovering at least a portion of the heat such as latent heat from the vapor.

It is to be understood that the flowchart of FIG. 6 illustrates an architecture, functionality, and operation of an example of the present disclosure. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowchart of FIG. 6 illustrates a specific order of execution, the order of execution may differ from that which is depicted. For example, the order of execution of two or more blocks may be scrambled relative to the order illustrated. Also, two or more blocks illustrated in succession in FIG. 6 may be executed concurrently or with partial concurrence. All such variations are within the scope of the present disclosure.

The present disclosure has been described using non-limiting detailed descriptions of examples thereof that are not intended to limit the scope of the present disclosure. It should be understood that features and/or operations described with respect to one example may be used with other examples and that not all examples have all of the features and/or operations illustrated in a particular figure or described with respect to one of the examples. Variations of examples described will occur to persons of the art. Furthermore, the terms "comprise," "include," "have" and their conjugates, shall mean, when used in the disclosure and/or claims, "including but not necessarily limited to."

It is noted that some of the above described examples may include structure, acts or details of structures and acts that may not be essential to the present disclosure and which are described for illustrative purposes. Structure and acts described herein are replaceable by equivalents, which perform the same function, even if the structure or acts are different, as known in the art. Therefore, the scope of the present disclosure is limited only by the elements and limitations as used in the claims.

What is claimed is:

1. An image forming system, comprising:

a drying unit to apply heat in a form of heated air to liquid ink disposed on media to remove water from the liquid ink in a form of vapor and to recover at least a portion of the heat from the vapor and the media;

a vapor collecting and liquefying unit to collect the vapor and to transform the vapor into water to restore the water from the vapor;

an ink applicator unit to apply the liquid ink to the media disposed in a print zone to form images thereon;

an ink regeneration unit to provide the restored water to an ink concentrate to form restored liquid ink and to supply the restored liquid ink to the ink applicator unit; and a media handling unit to transport the media to and from the print zone.

2. The image forming system according to claim 1, wherein the ink applicator unit comprises at least one inkjet printhead.

3. The image forming system according to claim 1, wherein the ink regeneration unit comprises:

a mixing unit to mix the restored water with the ink concentrate to form the restored liquid ink; and an ink concentrate supply unit to supply the ink concentrate to the mixing unit.

4. The image forming system according to claim 1, wherein the drying unit further comprises:

a heat pump unit to heat air and direct the heated air to the liquid ink disposed on the media and the media; and an air circulation unit to establish a flow path for the heated air.

5. The image forming system according to claim 4, wherein the air circulation unit further comprises:

a drying chamber to selectively receive the media with the liquid ink disposed thereon and to receive the heated air from the heat pump unit; and a plurality of fans to direct the heated air into and out of the drying chamber.

6. The image forming system according to claim 5, wherein the media handling unit places the media into the drying chamber and changes an orientation of the media therein with respect to a direction of the heated air.

7. The image forming system according to claim 5, wherein the drying chamber further comprises:

a plurality of airflow directional members to control a direction of the heated air within the drying chamber.

8. The image forming system according to claim 1, wherein the drying unit further comprises:

at least one infrared drying member to provide infrared energy to the liquid ink disposed on the media to increase an evaporation rate of the water.

9. The image forming system according to claim 1, further comprising:

a control unit to control a handling of the media and a supplying of the restored liquid ink to the ink applicator unit, the control unit to provide print data to the ink applicator unit, media control data to the media handling unit, and to generate and provide ink consumption data to the ink generation unit.

10. The image forming system according to claim 9, further comprising:

an ink composition control unit in fluid communication with the restored liquid ink to control at least one parameter of the restored liquid ink in real-time.

11. An image forming system, comprising:

a drying unit to apply heat in a form of heated air to liquid ink disposed on media to remove water from the liquid ink in a form of vapor and to recover at least a portion of the heat from the vapor and the media; and a vapor collecting and liquefying unit to collect the vapor and to transform the vapor into water to restore the water from the vapor, wherein the drying unit further comprises:

a heat pump unit to heat air and direct the heated air to the liquid ink disposed on the media and the media; and an air circulation unit to establish a flow path for the heated air, wherein the air circulation unit further comprises:

a drying chamber to selectively receive the media with the liquid ink disposed thereon and to receive the heated air from the heat pump unit; and a plurality of fans to direct the heated air into and out of the drying chamber, wherein the heat pump unit further comprises:

a refrigerant;

an evaporator member to transform the refrigerant from a liquid state to a gas state to enable the refrigerant to absorb the heat to form exhausted air;

a condenser member to condense the refrigerant from the gas state to the liquid state to enable the refrigerant to release the heat to form the heated air;

an expansion valve to lower pressure of the refrigerant received from the condenser member and provide the refrigerant to the evaporator member; and a compressor member to increase a pressure of and circulate the refrigerant between the evaporator member, the condenser member, and the expansion valve.

12. The image forming system according to claim 11, wherein the air circulation unit further comprises:

an air circulation path to transport the heated air through the drying chamber and to the evaporator member;

an inlet temperature sensor to measure a first temperature of the heated air entering the drying chamber; and an outlet temperature sensor to measure a second temperature of the heated air leaving the drying chamber.

13. A method of drying liquid ink on a media of an image forming apparatus, the method comprising applying liquid ink onto a media;

placing the media with the liquid ink disposed thereon into a drying chamber;

heating air by transferring heat from a heat pump unit to air;

directing the heated air into the drying chamber and onto the liquid ink disposed on the media and the media to remove water from the liquid ink in a form of vapor;

directing exhausted air from the drying chamber to the heat pump unit to recover heat from the exhausted air;

restoring the water from the vapor; and generating restored liquid ink to be applied to respective media by mixing an ink concentrate and the restored water.

14. The method according to claim 13, wherein the heating air further comprises:

transferring the recovered heat from the heat pump unit to the air.

* * * * *